United States Patent [19]

Mueller

[11] 3,961,816

[45] June 8, 1976

[54] AUXILIARY DOOR LOCK

[75] Inventor: Theodore V. Mueller, Florissant, Mo.

[73] Assignee: Security Lock Systems, Inc., Florissant, Mo.

[22] Filed: July 3, 1975

[21] Appl. No.: 593,038

[52] U.S. Cl. ..... 292/148; 70/14; 70/90; 292/42; 292/288

[51] Int. Cl.[2] ..... E05C 19/18

[58] Field of Search ..... 70/14, 90, , 95; 292/32, 42, 148, 150, 288, DIG. 47

[56] References Cited

UNITED STATES PATENTS

| | | | |
|---|---|---|---|
| 1,167,175 | 1/1916 | Hicks | 292/42 |
| 1,658,762 | 2/1928 | Dickerson | 292/5 |
| 2,441,864 | 5/1948 | Bauer | 70/14 |
| 2,536,941 | 1/1951 | Jones | 292/288 |
| 3,094,861 | 6/1963 | Sayles | 70/95 |
| 3,526,421 | 9/1970 | Hirschler | 292/42 |
| 3,668,906 | 6/1972 | Josephart | 70/90 |

*Primary Examiner*—Albert G. Craig, Jr.
*Attorney, Agent, or Firm*—Ralph W. Kalish

[57] ABSTRACT

An auxiliary lock comprising a lock body for extension through an opening in the closure to be secured; there being a stop forming element on one end of said lock body for engaging one side portion of said door to limit the extension of said lock body therethrough, as well as to stabilize same in position. A bolt is presented for projecting through a bore in the extended portion of said lock body, in generally axially perpendicular relationship thereto. One end of said bolt is enlarged to limit its projection through said lock body bore, and the other end is received within a socket provided in the structure adjacent the door. A lock is engageable upon said bolt between said lock body and said socket.

12 Claims, 21 Drawing Figures

FIG. 1
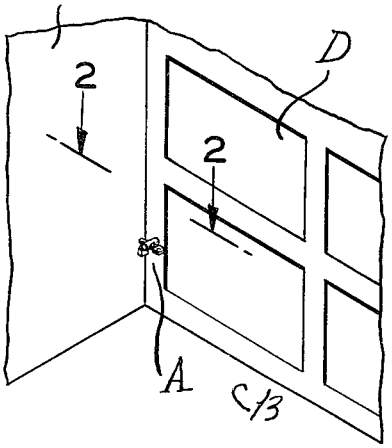
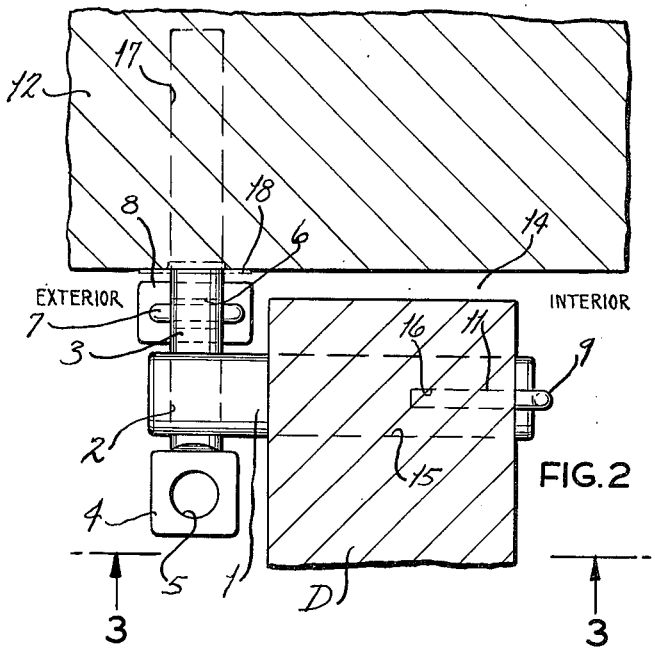
FIG. 2
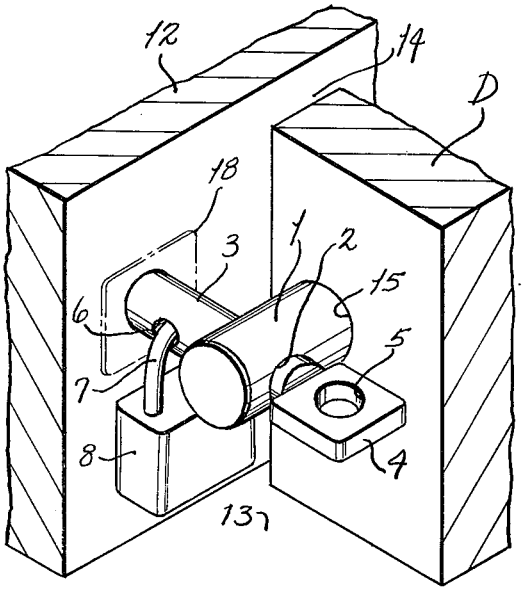
FIG. 4
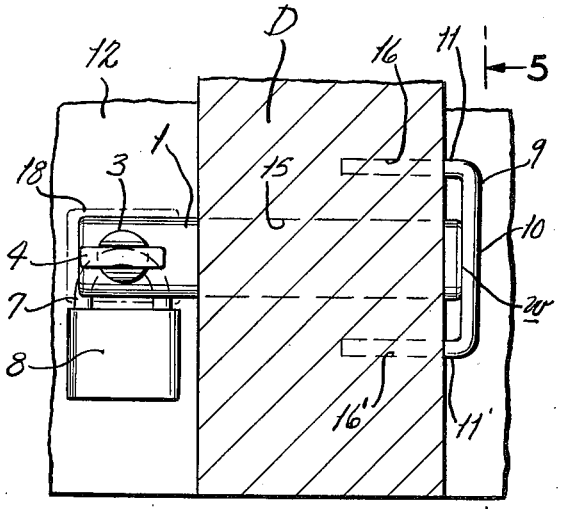
FIG. 3
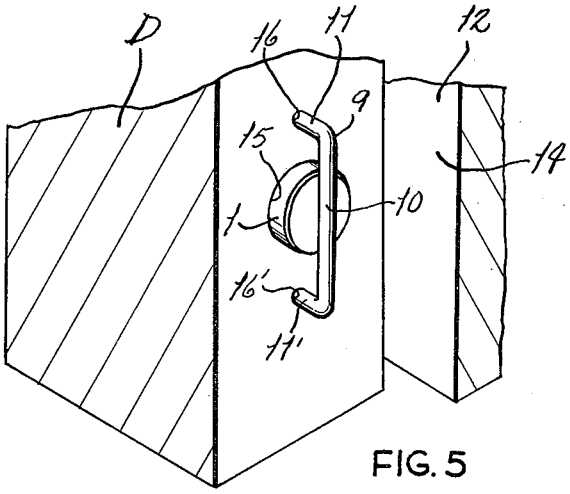
FIG. 5
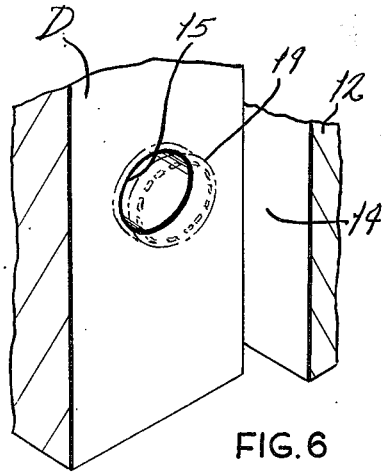
FIG. 6

FIG. 7
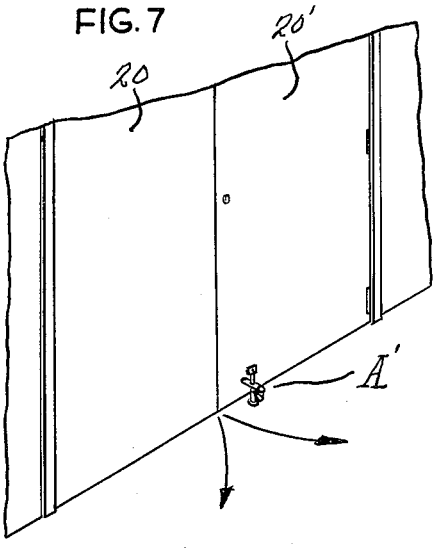
FIG. 8
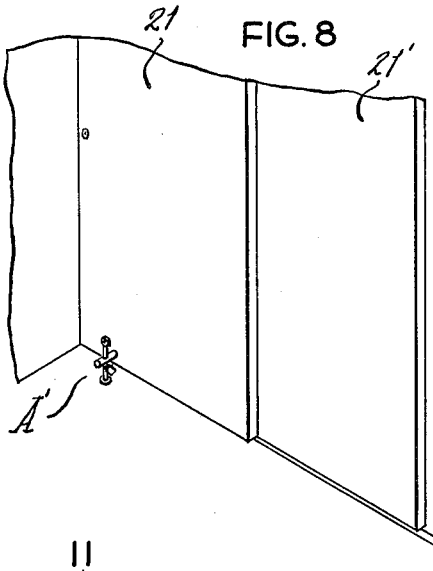
FIG. 9
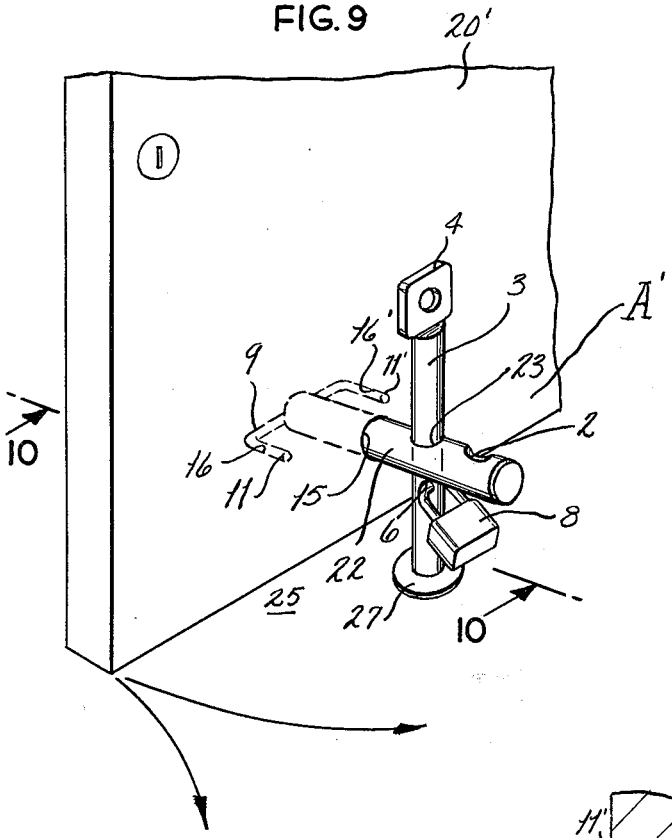
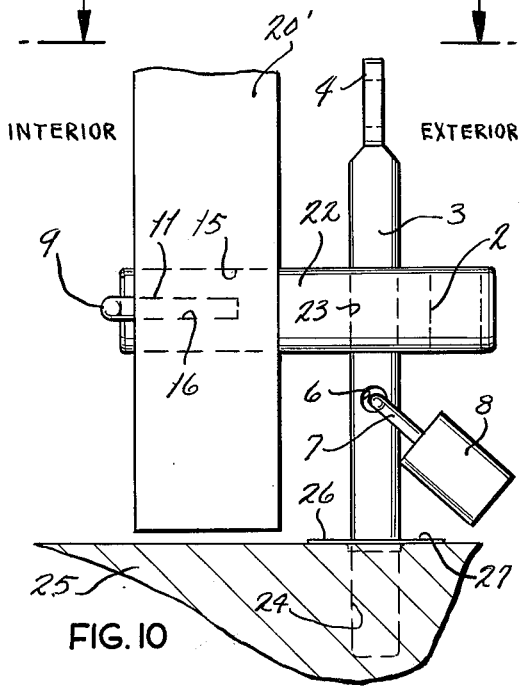
FIG. 10
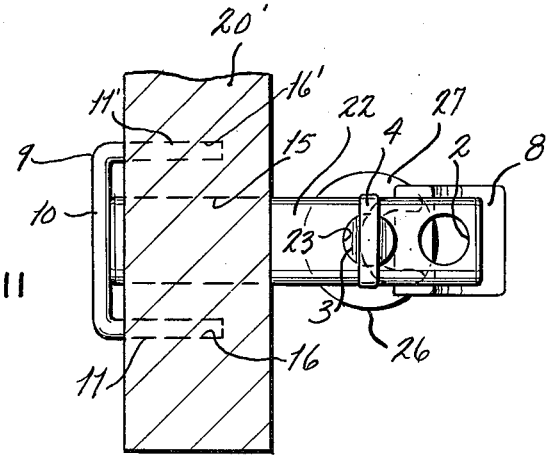
FIG. 11

AUXILIARY DOOR LOCK

BACKGROUND AND SUMMARY OF THE INVENTION

The present invention relates in general to locks and, more particularly to a new and useful improvement in an auxiliary lock which may be detachably mounted in operative position for providing enhanced security.

Heretofore, commercial, as well as often residential, establishments have found it necessary to change door locks as of the mounted, cylinder type after departure of an employee who has theretofore possessed the key for such lock. To effect change of cylinder locks is both time consuming and costly, and with considerable turnover of personnel, an establishment can, over a period of time, expend considerable sums in causing such lock changes.

Therefore, it is an object of the present invention to provide an auxiliary lock which is detachably mountable for use with all types of doors, such as, swinging, overhead, and sliding, as well as roll down grilles, and the use of which obviates the necessity of effecting a change in the permanent door lock.

It is another object of the present invention to provide an auxiliary lock of the character stated which, as indicated, may be easily installed for usage with all types of doors in an economical and quickly effected manner.

It is a further object of the present invention to provide an auxiliary lock of the type stated which is demountable for removal during door usage and which is easily mounted for security purposes by any unskilled individual.

It is another object of the present invention to provide an auxiliary lock which provides enhanced protection against unauthorized entry or intrusion and thus has wide application.

It is a further object of the present invention to provide an auxiliary lock of the character stated which comprises markedly few components, each of which is economically provided and simple in construction; which components are made of rigid material so as to be resistant to wear, thereby assuring of longevity of usage; which components are easily assembled into operative relationship and disassembled therefrom; and which components coact to provide an extremely durable lock.

BRIEF DESCRIPTION OF THE DRAWINGS

FIG. 1 is a perspective view illustrating the auxiliary lock constructed in accordance with and embodying the present invention, showing same as utilized with an overhead door.

FIG. 2 is a horizontal transverse sectional view taken on the line 2—2 of FIG. 1.

FIG. 3 is a vertical transverse sectional view taken on the line 3—3 of FIG. 2.

FIG. 4 is an enlarged perspective view taken at the arrow in FIG. 1.

FIG. 5 is a vertical view taken on the line 5—5 of FIG. 3.

FIG. 6 is a vertical view taken substantially on the line 5—5 of FIG. 3, but illustrating the lock body opening provided with a closure cap.

FIG. 7 is a perspective view of another form of auxiliary lock constructed in accordance with and embodying the present invention, illustrating the same as used with a pair of swinging doors.

FIG. 8 is a perspective view of the auxiliary lock shown in FIG. 7, but illustrating the same as used with sliding doors.

FIG. 9 is an enlarged perspective view of the auxiliary lock shown in FIG. 7.

FIG. 10 is a side elevational view taken on the line 10—10 of FIG. 9.

FIG. 11 is a horizontal view, in partial section, taken on the line 11—11 of FIG. 10.

FIG. 16 is a perspective view taken on the opposite side of FIG. 14 from that upon which FIG. 15 is taken.

DESCRIPTION OF PRACTICAL EMBODIMENTS

Figure 12:
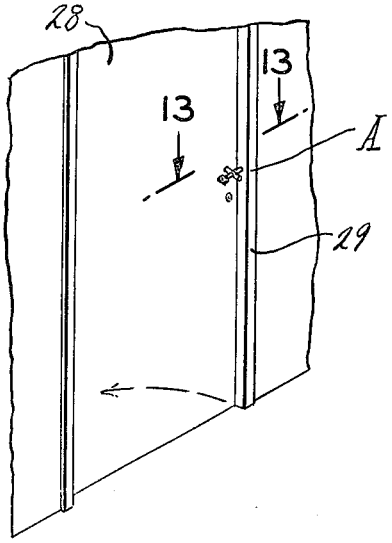
FIG. 12 is a perspective view of the lock of the present invention illustrating the same as used with a single swinging door.

Referring now by reference characters to the drawings which illustrate practical embodiments of the present invention, A generally designates an auxiliary lock for use with doors of all types, such as swinging, overhead, and sliding, as well as roll down grilles, etc. It is to be understood that lock A may be utilized, if desired, in lieu of the conventional door lock, such as the key-operated cylinder type. However, lock A has wide application for use with doors having permanent locks for the purpose of enhancing security in the event such permanent locks might be unauthorizedly removed, damaged, or ruptured in any way or otherwise opened.

Auxiliary lock A comprises an elongated, preferably cylindrical shaped lock body 1 as fabricated of metal or like rigid material. Said lock body 1 is provided with a transverse bore 2 located proximate one end thereof, the axis of which bore 2 is normal to the longitudinal axis of body 1 and is located at a preselected zone on said body as dictated by the use requirements, all as will become more apparent hereinbelow. Presented for slideable extension through bore 2 is an elongated bolt 3 being preferably smooth surfaced and fabricated of durable material of construction, such as preferably metal. At one of its ends bolt 3 is provided with a flattened head 4 having a transverse extent greater than the diameter of lock body bore 2; said head may be provided with a central opening 5. Bolt 3 is, spacedly from head 4, transversely drilled to provide a bore 6, the axis of which is perpendicular to the longitudinal axis of bolt 3 and with the distance between 6 and head 4 being at least greater than the diameter of lock body 1. Bore 6 is formed on such a radius as to receive the shackle 7 of a padlock 8. Said lock body 1 at its end remote from that adjacent bore 2 mounts a generally U-shaped stabilizer 9 which may be formed of suitable rod stock and bent into generally U, or channel, shape having a web 10 and parallel arms 11,11' which are axially parallel to the longitudinal axis of lock body 1. The diameter of the rod stock forming stabilizer 10 is relatively reduced with respect to that of lock body 1 and the same is rigid upon said lock body 1 as by welding the central zone of web 10 to the outer end of the adjacent end of lock body 1, as at *w*. Said arms 11,11' are relatively short in relationship to the length of lock body 1.

FIGS. 1–5, inclusive, illustrate lock A in operative, security-providing disposition with respect to an overhead door, indicated at D, being of the type adapted for vertical, reciprocal, sliding movement with respect to spaced apart side walls, as indicated at 12, a support surface 13, and a ceiling (not shown) which cooperate to form a door opening 14 for which said door D serves as a closure. Door D, adjacent one lateral edge thereof and preferably in its lower portion, is provided with an opening 15 which extends through said door D from front to back thereof, which opening is of appropriate diameter for projection therethrough of lock body 1.

Also drilled or otherwise provided in said door D, on opposite sides of said opening 15, are interiorly opening, relatively shallow, narrow recesses 16,16' for accepting arms 11,11' of stabilizer 9. As shown in the drawings, said recesses 16,16' are above and below opening 15 with their axes perpendicular to that of bore 2 which will be presented exteriorly of the outer face of door D since stabilizer 9 is in engaged condition. Consequently, the length of lock body 1 will be determined by the thickness of the door to be services so that said bore 2 will be spaced an adequate distance therefrom to allow of engagement with bolt 3 and the disposition of lock 8 upon said latter. As thus suggested, bolt 3 is passed through bore 2 in a direction toward the proximate side wall 12 for reception of its inner end portion within an opening 17 formed in such wall and being dimensioned for snug reception of said bolt 3. If desired, an annular or rectangular wall finish plate 18 may be provided at the outer end of opening 17. The penetration of bolt 3 within opening 17 is controlled in the first instance by abutment of head 4 against lock body 1, but in any event by reason of presenting bore 6 for suitable accessibility to allow engagement of padlock 8 therein.

From the foregoing it will thus be seen that auxiliary lock A is quite simply installed, there having been provided a single opening in the adjacent side wall and three openings in door D, which latter receive lock body 1 and arms 11,11'. Door D is thus anchored to the adjacent side wall 12 so that unauthorized upward sliding movement is inhibited and said lock A is firm in engaged condition by reason of the firmness of lock body 1 in position.

The opening of door D is easily accomplished by the mere unlocking of padlock 8 and the removing of same from bolt 3, and then with the withdrawal of bolt 3 from lock body 1 and a successive withdrawal of the latter from door D. Thus, the coaction of the three basic components, namely lock body 1, bolt 3, and padlock 8 are unique and permit of ease of interengagement and disassembly without any developed skill on the part of the user. When auxiliary lock A is in withdrawn state, the inner end of door opening 15 may be provided with a snap-in cap 19 for appearance purposes. A similar cap may be utilized at the other end of such opening if desired.

It will thus be seen that the user will insert lock body 1 in the inner side of the door D, then close said door, and from the exterior interengage the bolt and padlock 8.

Referring now to FIGS. 7–11, inclusive, another form of auxiliary lock is indicated at A' and being adapted for use with companion swinging doors, as at 20,20' (FIG. 7) or sliding doors, as at 21,21' (FIG. 8), wherein said lock A' is floor mounted, as distinguished from wall mounted as shown in FIG. 1. It is to be understood that like components of auxiliary lock A' and auxiliary lock A will bear the same reference numerals for facilitating description. Said lock A' comprises a relatively elongated lock body 22 which differs from lock body 1, as described hereinabove solely with respect to length so as to incorporate at least an additional transverse bore 23 located inwardly of bore 2 and being axially parallel therewith and of like diameter so that bolt 3 may extend through either of such bores as may be required depending upon door thickness and like considerations. It will be seen that the opening 15 and recesses 16,16' provided in door 20' are so related that their longitudinal axes lie within the same horizontal plane (as distinguished from the same vertical plane as with the usage shown in FIG. 1) so that when lock body 22 is in operative position with its forward bore-bearing end extending forwardly or exteriorly of door 20' said bores 2,23 will be in vertically disposed condition. With lock body 22 so disposed bolt 3 is then caused to project downwardly through the selected bore 2 for reception of the lower, or head-remote, end of said bolt 3 within a socket or Therefore, 24 provided in the support surface or floor 25. Engaged within the upper end of socket 24 may be a finish plate 26 having a diametrally extended upper portion 27 for disposition upon the upper surface of floor 25. Padlock 8 is then engaged within bore 6 of bolt 3 for placing lock A' in secured condition.

Accordingly bolt 3 is firmly disposed in latched condition and opening of door 20' is thereby reliably inhibited. With companion swinging doors, as 20,20', the same are customarily constructed so that the door bearing the latch box may not be opened until the latch-bearing door has been previously opened. Therefoe, it is only requisite that auxiliary lock A' be engaged to the latch-carrying door or doors of this type.

In view of the foregoing the utilization of lock A' with sliding doors, as 21,21', is indeed obvious since the components are in the same relationship as with respect to the companion swinging doors and with bolt 3 being received at its lower end within a socket within the floor 35. Similarly with companion sliding doors the non-lock carrying door may not be shifted to opened condition as long as the door with the lock is in locked condition. Thus, but a single auxiliary lock A' will effectively inhibit unauthorized opening of locked sliding doors.

Figure 13:
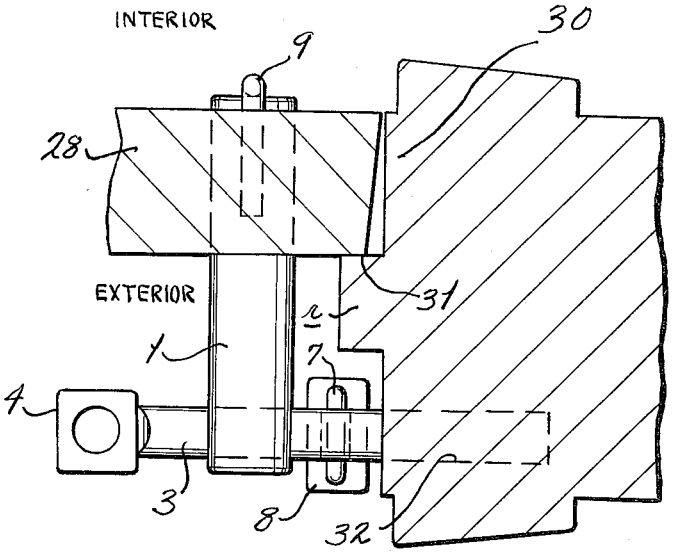
FIG. 13 is a horizontal transverse sectional view taken on the line 13—13 of FIG. 12.
Figure 14:
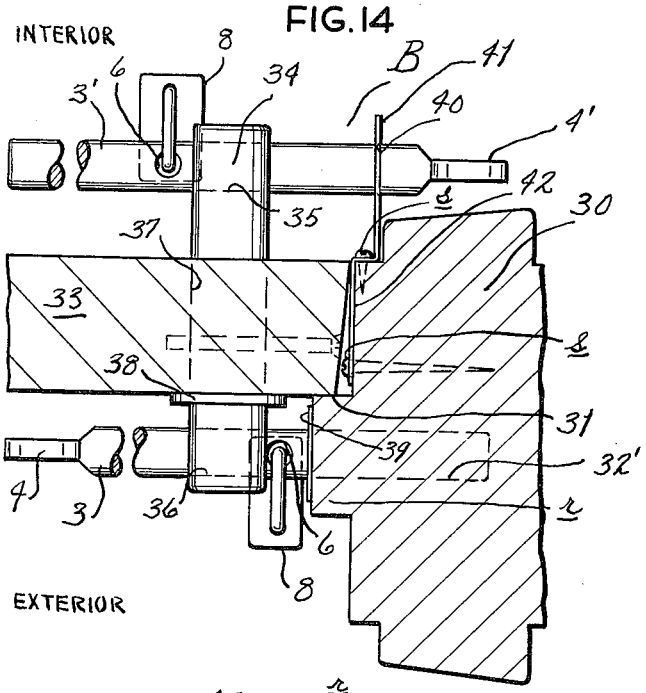
FIG. 14 is a horizontal transverse sectional view taken substantially on the line 13—13 of FIG. 12, but showing a still further form of auxiliary lock constructed in accordance with and embodying the present invention.
Figure 15:
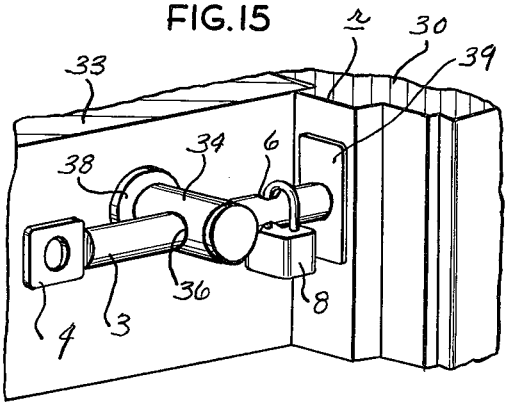
FIG. 15 is a perspective view taken at the arrow in FIG. 14.
Figure 16:
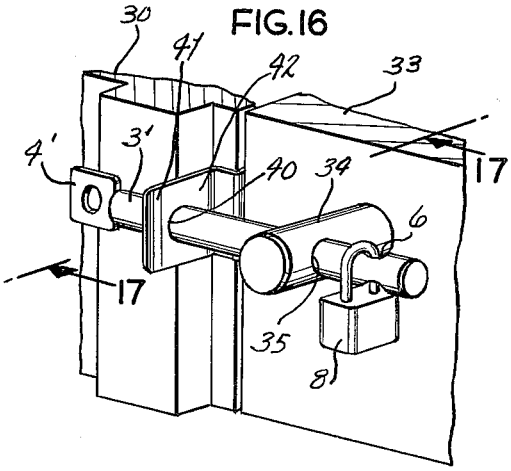
Figure 17:
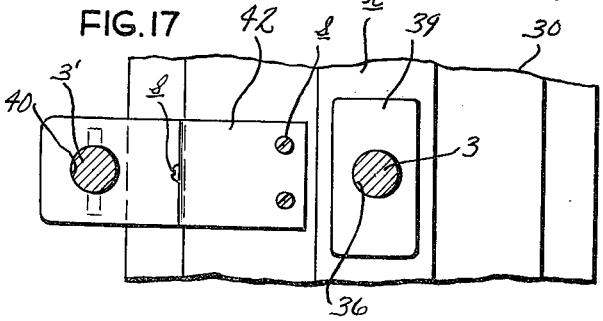
FIG. 17 is a vertical view, in partial section, taken on the line 17—17 of FIG. 16.
Figure 18:
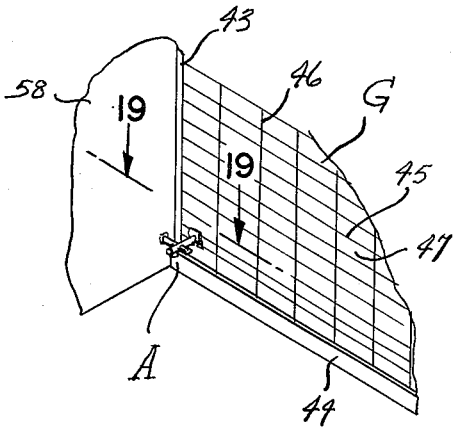
FIG. 18 is a perspective view of another form of auxiliary lock constructed in accordance with and embodying the present invention, illustrating the same in operative condition with respect to a roll down grille.
Figure 19:
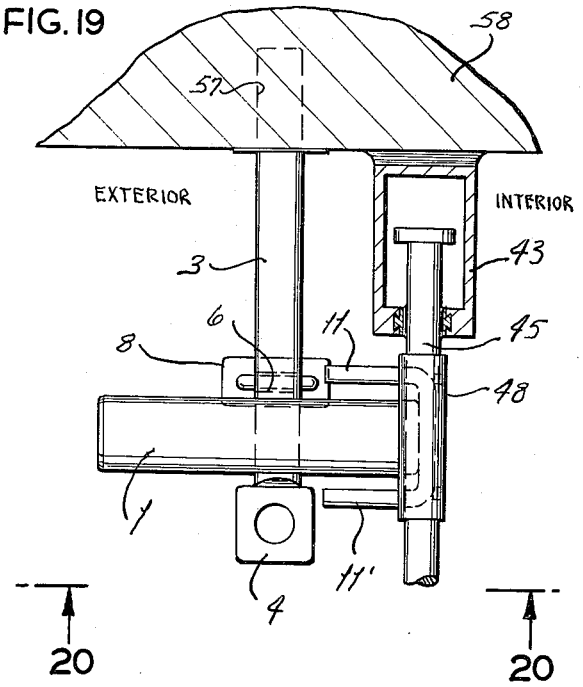
FIG. 19 is a top plan view, in partial section, taken on the line 19—19 of FIG. 18.
Figure 20:
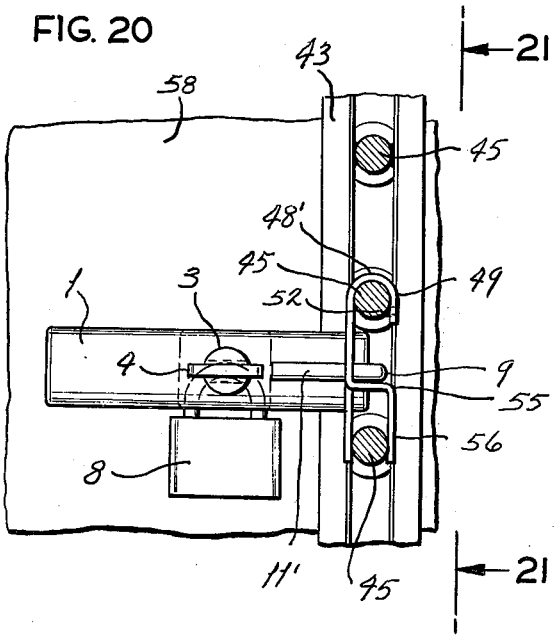
FIG. 20 is a vertical view, taken in partial section, on the line 20—20 of FIG. 19.
Figure 21:
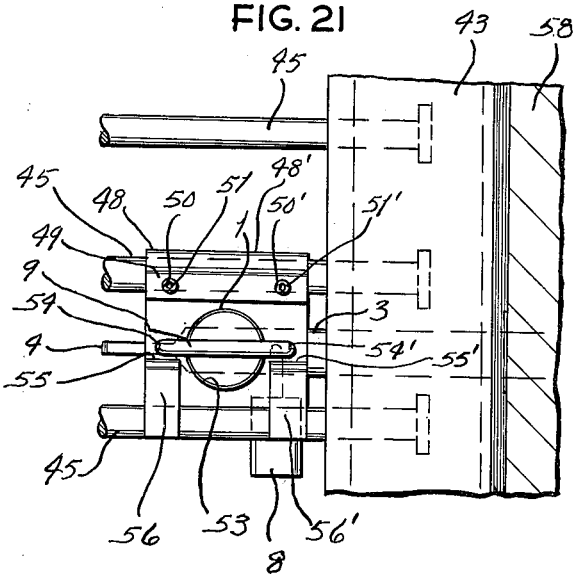
FIG. 21 is a fragmentary vertical view taken on the line 21—21 of FIG. 20.

Turning now to FIGS. 12 and 13 there is illustrated the application of auxiliary lock A, above described, for utilization with a single swinging door which upon opening swings inwardly as opposed to the outward swinging of the jamb-mounted doors 20,20' shown in FIG. 7. In this connection it will be seen that the single door, indicated at 28, is mounted within a door frame 29 having a jamb 30 with the substantially central inwardly projecting rib *r* forming a shoulder or rearwardly presented stop or abutment surface 31, limiting forward swinging of said door 28 so that the same is openable by rearward swinging, as indicated by the arrow in FIG. 12. For this purpose the components of lock A will be in the same general relationship as that shown in FIG. 4 with overhead sliding door D. The head-remote end of bolt 3 is received within a socket 32 formed in jamb 30 forwardly, or on the exterior side, or rib *r*.

Referring now to FIGS. 14–17, inclusive, a further form of auxiliary lock, indicated generally B is illustrated which is of the type for providing double security in that it may be locked on both sides of a door 33, as of the hinged type, and being disposed within a door frame (not shown) having a jamb 30, stop shoulder 31, and rib *r* corresponding to the structure shown in FIG. 13. Lock B comprises a cylindrical solid elongate body 34 being provided at its ends with axially parallel transversely extending bores 35,36. Door 33 adjacent its free edge and preferably above the permanent lock is provided with an opening 37 extending therethrough, from front to back, and being of a diameter suitable for accepting lock body 34, which is understandably of a length greater than that of opening 37 so that bores 35,36 will be located interiorly and exteriorly, respectively, of door 33. A diametrally enlarged collar 38 is provided upon lock body 34 proximate, but inwardly of, bore 36 to limit extension of lock body 34 through opening 37 toward the interior side of door 33. As will be shown, the remaining components of lock B are of like construction as those described in conjunction with lock A above so that the same will bear like reference characters. Thus, a bolt 3 extends through bore 36 for reception of its head-remote end within a socket 32' formed in jamb 30 but substantially transversely centrally of rib *r* with there thus being a padlock 8 engaged through bore 6 between lock body 34 and said rib *r*. A finish plate 39 may be disposed upon rib *r* about the opening of socket 32'.

Extending through bore 35 is another bolt 3' of identical construction as bolt 3, but though being axially parallel to bolt 3 is in reverse relationship thereto so that its bore 6 and the padlock 8 carried therein is on the opposite or jamb-remote side of lock body 34 than the bore 6, and its retained padlock 8, of bolt 3'. Said bolt 3' also projects through an aperture 40 formed on the interiorly extending (as considered from the inside of door 33) flange 41 of an upper plate 42 secured to jamb 30, as by screws *s*. Said aperture 40 is of less diameter than the cross section of head 4' of bolt 3'. Lock B permits door 33 to be secured from either side. Thus, as in apartments, a dweller may secure lock B from the inside during night and from the outside when being away during the day. Although it is physically feasible, it is unlikely that door 33 will be simultaneously secured on both sides as it would require the services of two individuals to effect such operation. But, as stated, said lock B does demonstrate the versatility of the present invention for residential usage as opposed to commercial usage wherein doors are normally secured from the exterior.

Referring now to FIGS. 18–21, inclusive, a further application of auxiliary lock A is illustrated, the same being shown as utilized with a grille G, as of the overhead or roll-down type, comprising vertical and horizontal guides 43,44, respectively, at the lateral and upper and lower ends of said grille G for maintaining the end portions of transversely extending and vertically presented rods 45,46, respectively, being in intersecting mutual perpendicular relationship for developing the particular grille pattern. It is to be recognized that the vertical spacing, as at 47, between adjacent horizontal rods 45 may be of varying extent if desired. The components of auxiliary lock A being substantially identical with said lock A described hereinabove, will, understandably, be identified by like reference numerals.

Provided for mounted suspension from horizontal rod 45, preferably in the lower portion of said grille G and adjacent one guide 43 is an adapter plate 48 having its upper end, as at 48', formed on a radius for disposition over the particular rod 45 and having a short skirt-like extension 49 on its normally inner side; said skirt 49 being provided with a pair of spaced-apart openings 50,50' for receiving screws 51,51' as preferably of the Allen head type for tightly engaging the inner confronting portion of the supporting rod 45, as at 52. The heads of said screws 51,51' may be filled with a suitable cementitious material, as of epoxy, so as to inhibit removal. At its central portion plate 48 is provided with an enlarged central opening 53 and a pair of diametrally aligned, but laterally spaced apertures 54,54' for respectively receiving lock body 1 and arms 11,11' of the associated stabilizer 9. Thus, said lock body 1 will be inserted from what would be normally the interior side of grille G when in closed condition so that the end remote from stabilizer 9 will extend exteriorly. Downwardly of apertures 54,54' said plate 48 is bent inwardly, as at 55,55', and thence downwardly at 56,56' to form lateral depending tongues which abut on their outwardly directed surface against the inner face of the next adjacent horizontal rod 45 beneath that from which said plate is suspended (see FIG. 20). The lower central portion of plate 48 between tongues 56,56' continues downwardly in coplanar relationship with the major portion of said plate so as to abut on its inner face the confronting portion of said next below horizontal rod 45, which latter is thereby bracketed, as it were, by said plate and said tongues 56,56', inhibiting undesired shifting of said plate 48 in usage.

Bolt 3 at its head remote end is accepted within a socket 57 formed in the adjacent building wall 58, as in the manner above described. Padlock 8 is engaged upon said bolt for completing the locking relationship, all as set forth hereinabove. It is to be understood that bolt 3 may have a plurality of spaced apart transverse bores 6 so as to locate padlock 8 in appropriate position depending upon the relationship of the structural components.

From the foregoing it will be seen that auxiliary lock A may be easily itlized with grille-type doors as opposed to those of solid or unbroken paneling and thereby demonstrating the marked versatility of the present invention.

Having described my invention, what I claim and desire to obtain by Letters Patent is:

1. An auxiliary lock in combination with a closure mounted within a closure frame for movement between open and closed condition, said lock comprising an elongated lock body, said closure having an opening adjacent said frame for extension therethrough of said lock body, means limiting the extension of said lock body through said closure opening, said lock body having at least one transverse bore through its extended portion, an elongated bolt dimensioned for projection through said bore, means at one end of said bolt for limiting projections of said bolt through said lock body bore, said closure frame having a socket receiving the other end of said bolt, and means detachably engageable upon said bolt between said socket-received end and said lock body.

2. An auxiliary lock and mounted closure as defined in claim 1 and further characterized by said transverse bore in said lock body being axially perpendicular to the longitudinal axis of said lock body, and said bolt having a transverse bore with said detachably engageable means being engaged within said bolt bore.

3. An auxiliary lock and mounted closure as defined in claim 2 and further characterized by said detachably engageable means being a padlock having a shackle projecting through said bolt bore.

4. An auxiliary lock and mounted closure as defined in claim 3 and further characterized by said bolt having a plurality of axially parallel bores between said socket received end and said lock body whereby said padlock may be optionally engageable therein.

5. An auxiliary lock and mounted closure as defined in claim 1 and further characterized by said lock body having a plurality of transverse bores whereby said bolt may be selectedly projectable therethrough.

6. An auxiliary lock and mounted closure as defined in claim 1 and further characterized by said means limiting the extension of said lock body comprising a generally U-shaped member having a web and parallel arms, means fixing said web upon the confronting end of said lock body with said arms axially parallel to the longitudinal axis of said lock body, said closure having apertures on either side of said opening for receiving said arms to stabilize said lock body in operative position.

7. An auxiliary lock and mounted closure as defined in claim 6 and further characterized by said arms being axially normal to the transverse bore of said lock body.

8. An auxiliary lock and mounted closure as defined in claim 6, and further characterized by said arms being axially parallel to the axis of the bore of said lock body.

9. An auxiliary lock and mounted closure as defined in claim 1 and further characterized by said closure frame embodying vertical components adjacent side edges of said closure, and said socket being disposed within the proximate vertical frame component.

10. An auxiliary lock and mounted closure as defined in claim 1 and further characterized by said closure frame having a sill-forming component, said socket being disposed within said sill-forming component of said closure frame.

11. An auxiliary lock and mounted closure as defined in claim 1 and further characterized by said closure being of grille-forming pattern having spaced apart horizontal elements, an adapter plate engaged upon adjacent transverse elements and having an opening therethrough for extension of said lock body.

12. An auxiliary lock and mounted closure as defined in claim 1 and further characterized by said limiting means at one end of said bolt comprising a flattened head having a cross section greater than that of said bolt.

* * * * *